United States Patent [19]

Staroste et al.

[11] 4,093,305

[45] June 6, 1978

[54] SUN PROTECTION

[76] Inventors: Joachim Staroste, Steinhaagweg 9, 6490 Schlüchtern-Niederzell; Peter Heuer, Nordstr. 25, 6497 Steinau, both of Germany

[21] Appl. No.: 765,674

[22] Filed: Feb. 4, 1977

[30] Foreign Application Priority Data

Dec. 11, 1976 Germany ..... 2656245

[51] Int. Cl.[2] ..... A47C 7/62

[52] U.S. Cl. ..... 297/184; 5/113

[58] Field of Search ..... 297/184; 5/113, 114, 5/57, 362

[56] References Cited

U.S. PATENT DOCUMENTS

| | | | |
|---|---|---|---|
| 270,224 | 1/1883 | Johnson | 297/184 X |
| 699,835 | 5/1902 | Chorlfon | 5/113 |
| 909,411 | 1/1909 | Hockney | 5/57 R |
| 1,021,930 | 4/1912 | Jackson | 5/362 |
| 1,374,531 | 4/1921 | Smith | 5/113 X |
| 1,738,219 | 12/1929 | Wickstrum | 5/57 R |
| 2,208,945 | 7/1940 | Miller | 5/57 R |
| 3,241,160 | 3/1966 | Escobar | 297/184 X |

FOREIGN PATENT DOCUMENTS

| | | | |
|---|---|---|---|
| 499,747 | 12/1950 | Belgium | 5/113 |

*Primary Examiner*—Francis K. Zugel
*Attorney, Agent, or Firm*—Leonard H. King

[57] ABSTRACT

A sun protection consisting of at least two frame-type supporting beams. The beams are formed of respectively one cross beam and two lateral beams adapted to be put together, with mounting ears. These ears are provided at the bottom ends of the lateral beams which ears are seated on respectively one bolt of a clamp holder provided with a clamping element.

9 Claims, 11 Drawing Figures

SUN PROTECTION

BACKGROUND OF THE INVENTION

A sun protection of the afore-mentioned type is generally known especially in connection with so-called "Hollywood beds" in which, however, the sun protection forms an integral part of the rocking frame. Moreover, such sun protections are known with simple deck-chairs having wooden frames at the upper frame portion of which is disposed a corresponding wooden structure provided with a fabric for protection against the sun.

SUMMARY OF THE INVENTION

Basic to the invention is the problem of providing a sun protection adepted to be easily mounted on a deck-chair, a camping chair or the like which as a whole can be adjusted at various angles relative to the respective angle of incidence, which, on the one hand, can be easily folded together for room-saving purposes and on the other hand, can be folded together along with the reclining chair and transported therewith in associated condition and which, finally, is inexpensive to produce from extremely simple parts.

This problem has not been solved by the sun protections of the afore-mentioned type, i.e. conventional sun protections are intended to be improved in the sense of the problem basic to the present invention.

This problem or object is solved by a sun protection according to the invention in that the at least two frame-type supprting beams are formed of respectively one cross beam and two lateral beams adapted to be put together, with mounting ears being provided at the bottom ends of the lateral beams which ears are seated on respectively one bolt of a clamp holder provided with a clamping element.

Advantageous embodiments of this basic solution are as following:

The cross and lateral beams may be formed of straight tubes while the angular connections and the mounting ears may be formed of connecting elements adapted to be detachably inserted under tension into the tubes provided with slots at the ends thereof; the mounting ears may be formed as ears open at one side and laterally slidable onto the clamping bolt; the clamping holder is preferably formed of a viscous-elastic plastic (e.g. polyamide) provided with a clamping groove; the clamping groove of the clamping holder at one side may be defined by a clamping jaw adapted to be clamped; the clamping holder is preferably formed as an angular element in the one leg of which the clamping bolt is disposed in removable but anti-rotational manner; the cross and lateral beams are preferably provided with a plastic coating, for example of PVC, also covering the end slots; moreover, the angular connections and mounting ears are equally formed preferably of viscous-elastic plastic, e.g. polyamide and, finally, the foldable fabric for protection against the sun is provided with tucket folds to put the cross beams therethrough.

The above description as well as further objects, features and advantages of the present invention will be more fully appreciated by reference to the following detailed description of the presently offered but nontheless illustrative embodiments in accordance with the present invention.

BRIEF DESCRIPTION OF THE DRAWING

In the various figures of the drawing, like reference characters designate like parts.

In the drawing.

DESCRIPTION OF THE PREFERRED EMBODIMENTS

Figure 1:
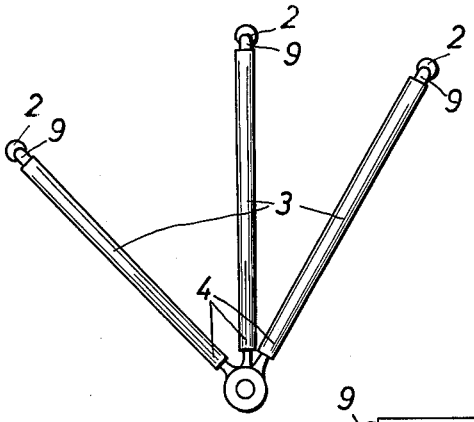
FIG. 1 is a side view of the sun protection.
Figure 9:
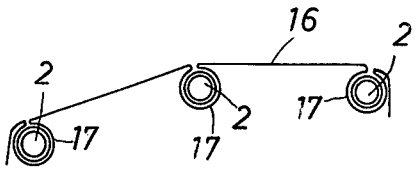
FIG. 9 is a sectional view of the association of the sun protection to the cross beams.

In the demonstrated form of embodiment the entire sun protection, designated as a whole by reference numeral 18, is composed of three supporting beams 1 (FIG. 2) which are respectively formed of a cross beam 2 and two side beams 3. The cross beams 2 and the side beams 3 are connected to angular connections 9 in detachable manner, with the side beams 3 at the bottom ends 4 thereof being provided with mounting ears 5 and 5', respectively, By way of these mounting ears 5 and 5', respectively, the supporting beams 1 with respect to one another are swingably seated on a clamping bolt 7 and with a clamping element 6 are clamped at clamping bolt 7 provided with threads 19 against leg 14 of the clamping holder 8 formed as the angular member 13, in the desired position relative to one another while expanding the sun protective fabric 16.

Figure 4:
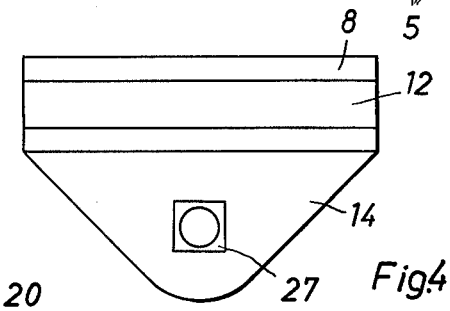
FIG. 4 is a lateral view of the clamping holder.
Figure 10:
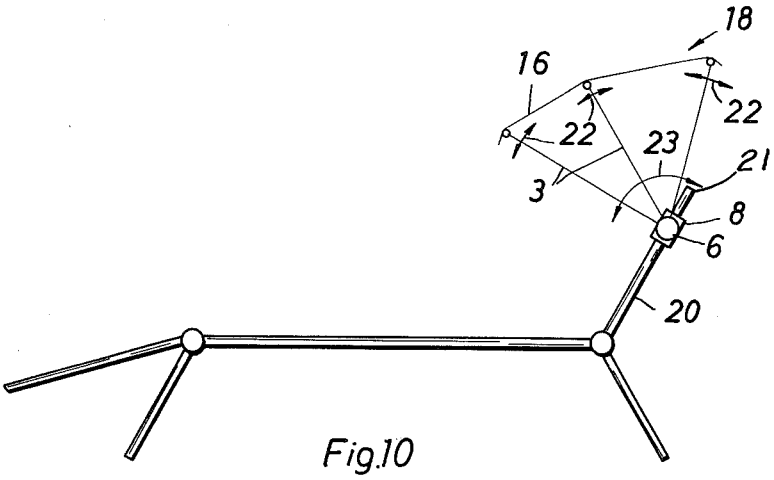
FIG. 10 is a side view of a deck-chair provided with the sun protection.

The clamping holder composed of a viscous-elastic plastic comprises a longitudinal groove 12 (FIG. 4) by way of which it is — as demonstrated in FIG. 10 — opened at a side beam 20 of, for example, a deck-chair.

Figure 2:
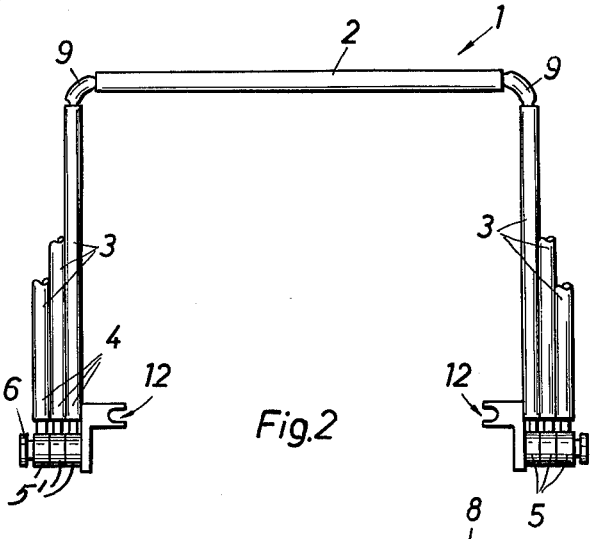
FIG. 2 is a front view of the sun protection.

This will, of course, apply to both sides of the supporting beams 1 according to FIG. 2. The entire sun protection may, of course, have essentially larger dimensions than demonstrated relative to the usual deck-chair size thus being able to overshadow an essentially larger area than the head region. The two clamping holders could then be attached either further down at the beams 20 or also at the horizontal beams 21. As the supporting beams 3 with respect to one another are pivotable in the sense of the arrows 22 and the entire sun protection 18 as a whole may be swung in the sense of the arrows 23 it will be readily possible to individually adjust the shading.

Figure 11:
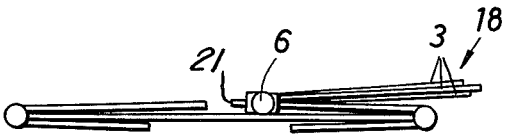
FIG. 11 is a side view of the deck-chair according to FIG. 10 in collapsed condition with the sun protection.

If the deck-chair is collapsed as demonstrated in FIG. 11 the sun protection 18 need not necessarily be removed but may remain fastened to the chair and be transported along therewith without causing any trouble.

Figure 5:
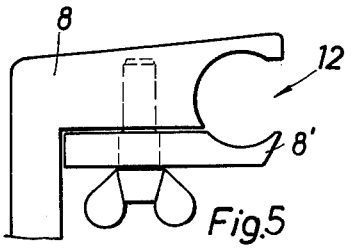
FIG. 5 is a side view of a special form of embodiment of the clamping holder.

In order to be able to attach the clamping holder 8 also at points other than the normal cross-sections of beams 20 the clamping groove 12 may also be defined at one side — as demonstrated by FIG. 5 — by a jaw 8′ adapted to be clamped.

The mounting ears 5 and the angular connections 9 are equally formed of viscous elastic plastic and are inserted with their lugs 24 grooved preferably in the longitudinal direction, into the open ends 4 of the lateral beams 3 and the cross beams 2, respectively, under tension but removably.

The thin-walled tubes 11 forming the cross and side beams 2,3 for this purpose are provided with slots 10 which, however, are also covered by the flexible plastic coating 15 of the tubes.

This construction permits complete disassembly of the entire sun protection and foling together the same in space-saving manner to form a small bunch.

Figure 7:
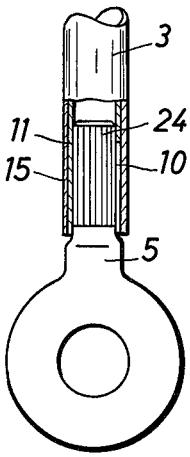
FIG. 7 is the sectional and front view of the arrangement of the mounting ear at the bottom end of a side beam.
Figure 8:
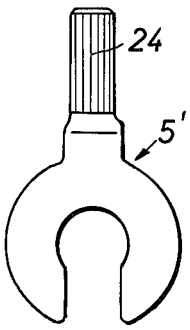
FIG. 8 is a side view of another form of embodiment of a mounting ear.

The mounting ears 5′ according to FIG. 5 may be open to one side like a horseshoe so that they may be put directly and laterally onto the clamping bolt 7 with no need for the clamping element 6 to be completely unscrewed from the winding 19 which would be required in the mounting ears 5 according to FIG. 7 in case of the assembly and disassembly, respectively. The clamping bolt 7 immediately under its flat head 25 includes a small square 26 by way of which it is seated in torsion-resistant manner in a corresponding square hole 27 in leg 14 of the clamping holder 8.

Figure 3:
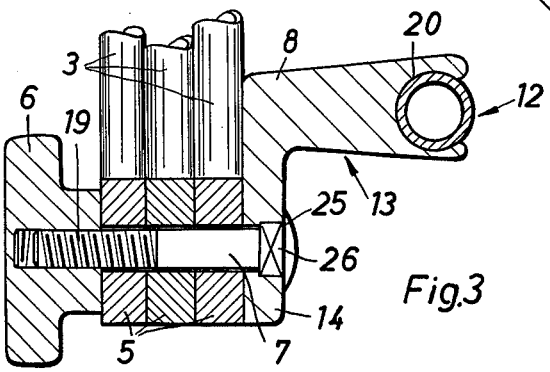
FIG 3 is a sectional view of the clamping holder.
Figure 6:
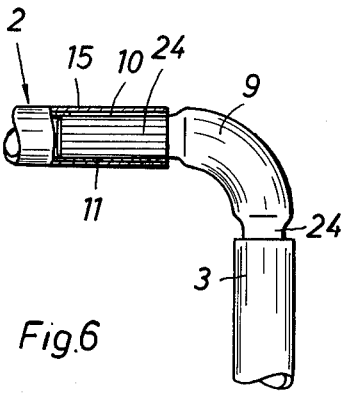
FIG. 6 is the angular connection of the cross and side beams, partly in section.

The mounting ears 5, 5′ can, of course, also be achieved in that the ends of the beams 3 are flat-pressed and perforated. In order that such ears can be clamped in the sense of FIG. 3 either correspondingly dimensioned intermediate rings will have to be provided or the beams will have to be so graded or offset that the ears are in close proximity with respect to one another.

There has been disclosed, therefore the best embodiments of the invention presently contemplated. However, it is to be understood that various changes and modifications may be made thereto without departing from the spirit of the invention.

What is claimed is:

1. A sun protection, especially for use with deck chairs, camping chairs, or the like, said sun protection comprising a plurality of U-shaped supporting beams each of which includes a central cross beam, a pair of laterally spaced apart side beams, a pair of angular connections for removably coupling the opposed ends of said central beam to one end of each of said side beams, a mounting ear removably connected to the end of each said side beam that is opposite said respective cross beam, a pair of clamping holders coupled to the end of said side beams opposite said respective cross beam for detachably securing said sun protection to a chair, a pair of clamping bolts adjustably coupling said mounting ears to each other and to a respective one of said clamping holders, said U-shaped supporting beams being angularly displacable with respect to each other and being angularly displacable as a unit with respect to said clamping holders, said clamping holders being formed as angular elements in one of which is removably disposed one of said clamping bolts in a torsion-resistant manner, and a foldable fabric covering said U-shaped supporting beams.

2. The sun protection according to claim 1 whereby said cross beam and said side beams are formed of straight tubes and said angular connections and said mounting ears are formed of elements that are adapted to be detachably inserted under tension into said tubes.

3. The sun protection according to claim 1 wherein the ends of said side beams that receive said mounting ears are slotted.

4. The sun protection according to claim 3 wherein said cross beam and said side beams are provided with a plastic coating covering said slots.

5. The sun protection according to claim 3 wherein said mounting ears are slotted and are open at one side whereby said mounting ears are slidable onto said clamping bolts.

6. The sun protection according to claim 1 wherein said clamping holders are formed of a viscus elastic plastic material and include a clamping groove that is adapted to engage a portion of the chair on which said sun protection is to be mounted.

7. The sun protection according to claim 6 wherein said clamping groove of said clamping holder is formed of two sections to thereby define a jaw that is adapted to be clamped to a portion of a chair on which said sun protection is to be mounted.

8. The sun protection according to claim 1 whereby said angular connections are formed of a viscus elastic plastic material.

9. The sun protection according to claim 1 whereby said foldable fabric is provided with tucked folds through which said cross beams extend.

* * * * *